US006760940B2

(12) United States Patent
Gladney et al.

(10) Patent No.: US 6,760,940 B2
(45) **Date of Patent: *Jul. 13, 2004**

(54) BED CONSTRUCTION WITH REDUCED SAGGING

(75) Inventors: Rick F. Gladney, Fairburn, GA (US); Kurtis Ling, Alpharetta, GA (US); Douglass D. Kinde, Alpharetta, GA (US)

(73) Assignee: Dreamwell, Ltd., Las Vegas, NV (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/152,249

(22) Filed: May 21, 2002

(65) Prior Publication Data

US 2002/0184712 A1 Dec. 12, 2002

Related U.S. Application Data

(63) Continuation of application No. 09/742,126, filed on Dec. 22, 2000, now Pat. No. 6,408,469, which is a continuation-in-part of application No. 09/482,591, filed on Jan. 13, 2000, now Pat. No. 6,243,900.

(51) Int. Cl.[7] ..... A47C 27/05
(52) U.S. Cl. ..... 5/727; 5/716
(58) Field of Search ..... 5/720, 727, 716, 5/655.8, 721, 690

(56) References Cited

U.S. PATENT DOCUMENTS

| | | | | |
|---|---|---|---|---|
| ,685,160 A | | 10/1901 | Marshall | |
| 1,321,095 A | | 11/1919 | Genge | |
| 1,459,540 A | * | 6/1923 | Labenz | 5/720 |
| 2,862,214 A | * | 12/1958 | Thompson et al. | 5/720 |
| 3,031,690 A | | 5/1962 | Ramsay | |
| 3,869,739 A | * | 3/1975 | Klein | 5/720 |
| 4,234,983 A | | 11/1980 | Stumpf | |
| 4,234,984 A | | 11/1980 | Stumpf | |
| 4,439,977 A | | 4/1984 | Stumpf | |
| 4,451,946 A | | 6/1984 | Stumpf | |
| 4,523,344 A | | 6/1985 | Stumpf et al. | |
| 4,578,834 A | | 4/1986 | Stumpf | |
| 5,016,305 A | | 5/1991 | Suenens et al. | |
| 5,040,255 A | * | 8/1991 | Barber, Jr. | 5/720 |
| 5,621,935 A | | 4/1997 | St. Clair | |
| 5,940,908 A | * | 8/1999 | Gladney | 5/263 |
| 6,023,803 A | * | 2/2000 | Barman | 5/716 |

FOREIGN PATENT DOCUMENTS

| | | | | |
|---|---|---|---|---|
| DE | G 88 09 029.9 | * | 2/1989 | 5/727 |
| FR | 1124527 | * | 10/1956 | 5/716 |
| GB | 2 168 250 A | | 6/1986 | |

* cited by examiner

*Primary Examiner*—Alexander Grosz
(74) *Attorney, Agent, or Firm*—Ropes & Gray LLP

(57) ABSTRACT

A bed construction having a one-sided mattress assembly supported on a rigid foundation. The one-sided mattress assembly includes a core of pocketed coil springs having a layer of resiliently compressible material covering the upper surface thereof and having a bottom surface constructed of a substantially rigid material without a compressible layer. The core of coil springs is attached to the bottom surface around its periphery. The foundation has a rigid inner construction and a noncompressible top layer. The bed construction reduces the amount of compressible padding in the mattress by one-half and consequently the mattress is capable of exhibiting a substantial reduction in the amount of permanent deflection in use.

20 Claims, 2 Drawing Sheets

BED CONSTRUCTION WITH REDUCED SAGGING

RELATED APPLICATIONS

This application is a continuation of Ser. No. 09/742,126 file date Dec. 22, 2000, now U.S. Pat. No. 6,408,469, issued Jun. 25, 2002, which is a continuation-in-part of Ser. No. 09/482,591 file date Jan. 13, 2000, now U.S. Pat. No. 6,243,900, issued Jun. 12, 2001, all of which are incorporated herein by referenced in their entirety.

BACKGROUND OF THE INVENTION

The present invention relates generally to a bed construction, and more particularly to a bed construction having a one-sided mattress assembly supported on a rigid foundation that offers significant reduction in the amount of permanent deflection or sagging of sleeping surface of the mattress.

A conventional inner spring mattress as known in the bedding industry generally comprises a resilient construction consisting of two sleep surfaces (a top layer and a bottom layer) enclosing an assembly of wire springs. The wire springs are typically covered with padding layers on the top and bottom surfaces, and the whole assembly is encased within a ticking, often quilted, that is sewn closed around its periphery to a border or boxing. For many years, one form of spring assembly construction has been known as Marshall construction. In Marshall construction, individual wire coils are each encapsulated in fabric pockets and attached together in strings which are arranged to form a closely packed array of coils in the general size of the mattress. Examples of such construction are disclosed in U.S. Pat. Nos. 685,160, 4,234,983, 4,234,984, 4,439,977, 4,451,946, 4,523,344, 4,578,834, 5,016,305 and 5,621,935, the disclosures of which are incorporated herein by reference in their entireties.

Conventionally, inner spring mattresses, with either pocketed coils or open coils, have had identical top and bottom layers. During normal life of such conventional mattresses some degree of permanent deflection, or sag, can develop in the mattress surfaces due to compaction of the component padding materials in the top and bottom layers. This permanent deflection can interfere with the mattresses' intended function of providing a supportive and resilient sleep surface. Inner spring mattress manufacturers recommend periodically rotating and turning over the mattress thereby utilizing the top and bottom sleep surfaces in order to counteract, minimize, and/or delay the aforementioned permanent deflection or sag. Under continued use, this compaction or sag becomes more permanent. The degree of permanent deflection is directly related to the type and amount of padding installed both over and under the wire spring core assembly. To remedy this shortcoming, manufacturers utilize materials that produce less permanent compaction. These materials are generally more dense but can be less comfortable and more expensive.

Conventional foundations, such as box springs, often contributed to the problem of sagging by providing a compressible top layer. Any additional compaction of the top layer of the foundation contributes to the overall sagging of the sleeping surface of the mattress.

Accordingly, it is desirable to provide a bed construction having an inner spring mattress assembly which exhibits a reduced amount of permanent deflection due to compaction of padding materials while at the same time exhibiting substantial comfort in use. It is further desirable to provide a mattress assembly that can be constructed by conventional known manufacturing techniques. Still further, it is desirable to provide a mattress assembly that is cost-effective to produce.

SUMMARY OF THE INVENTION

The present invention improves over the prior art by providing a bed construction with a one-sided mattress assembly supported on a rigid foundation. The one-sided mattress assembly includes a core of wire springs including, but not limited to, pocketed or open coil springs. The spring core of the mattress is covered by a layer of resiliently compressible material covering the upper sleeping surface thereof. The spring core of the mattress is supported on a bottom layer constructed of a substantially rigid material that is not generally compressible. The core of coil springs is attached to the bottom layer around its periphery. The rigid bottom layer of the mattress assures firm support for the coil springs and thereby reduces sagging that may result from the springs being poorly supported by the compressible padding under the springs of a conventional two-sided mattress.

In connection with the present invention, the padding for the top layer is selected to resist permanent compaction or deflection. Moreover, padding is only needed on the top layer of the mattress thereby reducing by one-half the amount of padding required. Consequently, the mattress construction of the present invention with a padded top layer and a rigid bottom layer necessarily reduces the amount of material that is subject to permanent compaction and therefore reduces the amount of permanent deflection of the mattress overall. Maintenance of the mattress of the present invention by rotating or turning the mattress over is also avoided.

In order to further reduce sagging of the sleeping surface of the mattress, a rigid foundation is provided to give further support to the rigid bottom layer of the one-sided mattress and therefore the spring core.

BRIEF DESCRIPTION OF THE DRAWINGS

The foregoing and other novel features and advantages of the invention will be better understood upon a reading of the following detailed description taken in conjunction with the accompanying drawings wherein.

DETAILED DESCRIPTION OF THE INVENTION

Figure 1:
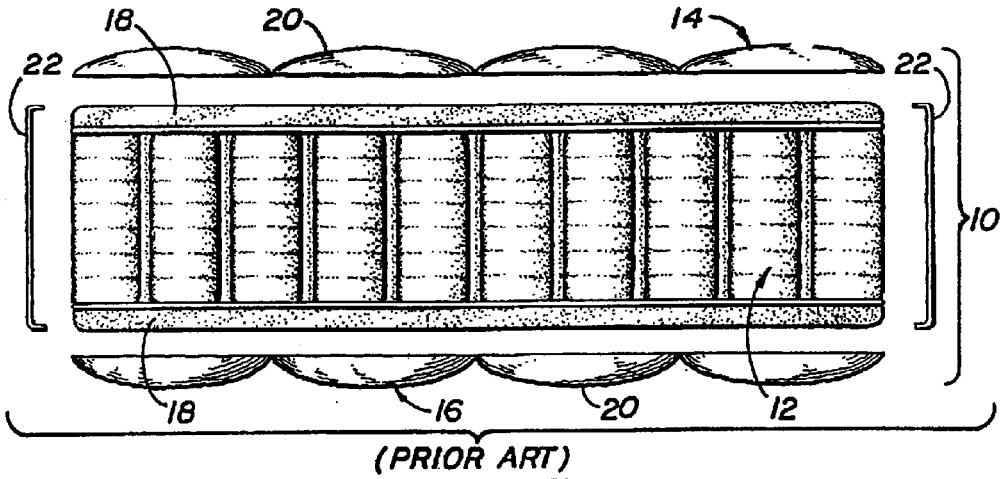
(PRIOR ART) FIG 1
FIG. 1 is an exploded cross-section view of a conventional two-sided inner spring mattress.

Referring now to the drawings, and initially to FIG. 1, a conventional two-sided mattress is illustrated in exploded cross-section and designated generally by the reference numeral 10. The conventional mattress 10 includes as a principal component a wire spring assembly 12 of Marshall spring coils, as will be described in detail hereinafter and which comprises the central core of the mattress 10. The mattress 10 could also incorporate an assembly of open coil springs or other wire inner springs. The mattress 10 has an upper sleep surface 14 and a lower sleep surface 16, and therefore, is of a conventional type intended to be turned over periodically to help minimize compaction of its padding material and the resulting sagging of the mattress 10. Padding material 18, which is identical on both sides 14 and 16 includes a layer of closed-cell foam such as polyurethane. Covering the material 18, on both sides of the mattress, is a ticking layer 20 which may be quilted and which may include additional foam in a manner well-known in the art. The ticking layers 20 are fastened such as by sewing to a border 22 which extends around the entire periphery of the core 12 of coil springs.

Figure 2:
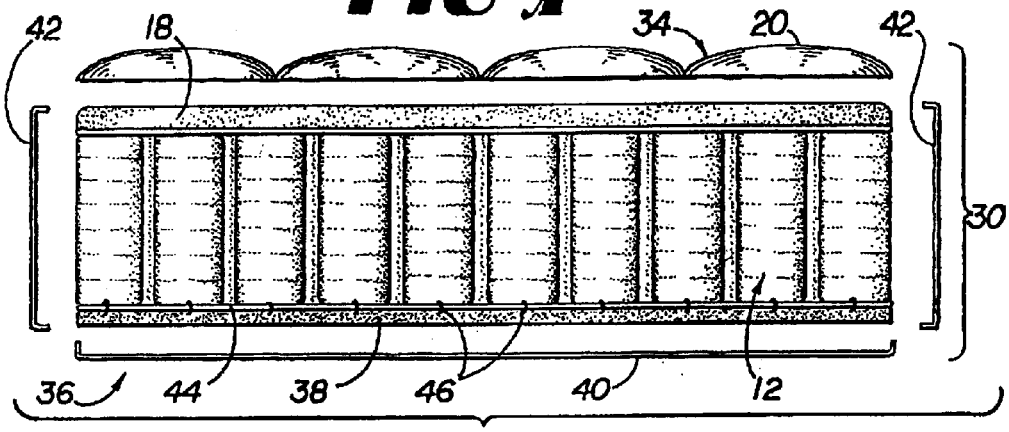
FIG. 2 is an exploded cross-sectional view of a one-sided inner spring mattress constructed according to the principles of the invention.

Turning now to FIG. 2, a mattress 30 constructed according to the invention is shown in exploded cross-section. The mattress 30, like the conventional mattress 10 illustrated in FIG. 1, has a central core 12 of the Marshall coils. The mattress 30, however, may have a central core 12 comprising open coil springs or other wire springs. An upper sleep surface 34 is formed over the central core 12 by a layer of foam padding 18 and a layer of ticking 20. In accordance with the invention, however, the mattress 30 has an underside 36, positioned under the central core 12 and which comprises a substantially rigid layer 38 of material covered by a thin layer 40 of a non-woven sheeting. A border 42 connects the ticking 20 and sheeting layer 40 and extends around the periphery of the coil spring assembly 12. A lower border wire 44 is secured to the coil spring assembly 12 around its periphery as well as to the layer 38 such as by hog rings 46.

Figure 3:
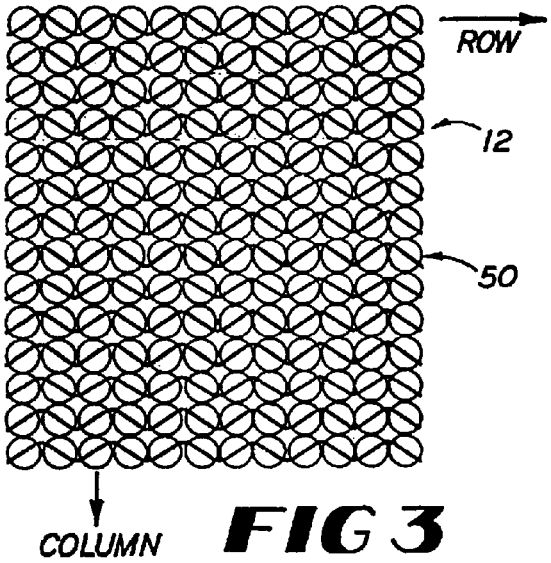
FIG. 3 is a schematic plan view of a complete assembly of Marshall coils for use in the mattress construction according to the present invention illustrated in FIG. 2.
Figure 4:
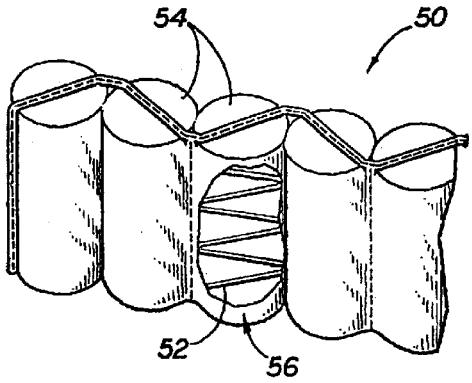
FIG. 4 is a partial perspective view, partly broken away, of the Marshall coil assembly illustrated in FIG. 3.

FIGS. 3 and 4 illustrate one form of mattress core 12 of the aforementioned Marshall coil construction. In this construction, closely positioned coil springs are aligned in a string assembly 50 (FIG. 4) wherein individual springs 52 are each encapsulated within a pocket of 54 of fabric material 56 which may be sewn or ultrasonically welded to create the pockets 54 and to create a unitary Marshall coil type assembly 12. An example of such construction is more fully disclosed in U.S. Pat. No. 5,621,935 which is commonly assigned herewith and the disclosure of which is incorporated herein by reference in its entirety. A person of ordinary skill in the art will appreciate that opened coil springs or other wire springs may be used for the mattress core 12 as well as Marshall coil springs.

As previously described, the sleeping surface 34 comprises a layer of foam padding 18 and a layer of ticking 20. The ticking 20 is of conventional construction. In accordance with the present invention, however, the foam padding 18 is specifically selected to provide comfort yet minimize compaction. Particularly, the foam padding 18 is a high density polyurethane foam having a density from about 1.0 lbs./cu. ft. to 2.5 lbs./cu. ft. The foam layer 18 also has a firmness in a range of between 10 and 55 ILD, where "ILD" refers to the standard Indented Load Deflection test. Within the ranges specified, the foam padding 18 for the sleeping surface 34 is selected to provide varying degrees of firmness or softness to accommodate individual preferences.

The relatively rigid bottom layer 38 is a high density polyurethane foam having a density of approximately 1.85 lbs./cu. ft. The foam layer 38 also has a firmness above 30 ILD. In practice, an ILD above 55 has proven to be most effective based on considerations of cost and durability. Other rigid materials may be used in place of the foam layer 38. Such materials may include solid plastic, wood, or other nonyielding rigid materials. To the extent such materials for the layer 38 yield to pressure, such materials must have at least a high degree of recoverability once the pressure has been removed so that the materials are not compacted.

Figure 5:
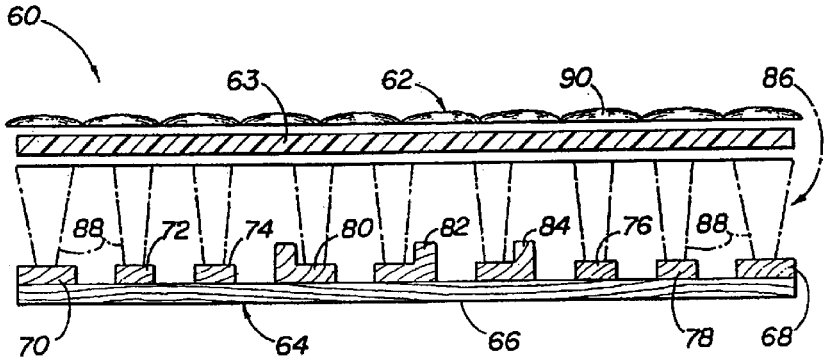
FIG. 5 is a partially exploded elevation view of a foundation used in connection with the present invention.

Turning to FIG. 5, there is shown a foundation 60 for use in connection with the construction of a bed in accordance with the present invention. The most important aspect of the foundation 60 for the present invention is providing a rigid top surface 62 to support the mattress 30 (FIG. 2). Rigid support of the mattress 30 by the foundation 60 further reduces the amount of sagging of the sleeping surface 34. In order to achieve rigid support of the mattress 30, the foundation 60 is constructed in accordance with the disclosure of commonly assigned U.S. Pat. No. 5,940,908, and particularly FIG. 6 of that patent.

The foundation 60 has a structural frame 64. The structural frame 64 has a rectangular border including a pair of side rails (only rail 66 is shown in FIG. 5). The side rails may be formed from standard lumber of construction grade in nominal 1×3 size, connected at a head end of the frame 64 by a head end rail 68 and at the foot end of the frame 64 by a foot end rail 70. The end rails 68 and 70 may be formed, for example, from a lower 1×2 end filler slat which butts the side rails in the plane thereof. Cross slats 72, 74, 76, 78, 80, 82, and 84 are positioned on the upper surfaces of the side rails and extend laterally to span the transverse distance between the side rails. Optionally, a longitudinally extending center support rail may be attached to an undersurface of the head and foot rails 68 and 70 and secured to an underside of each of the cross slats 72–84 to provide additional structural integrity and strength for the frame 64.

As further illustrated in FIG. 5, it will be seen that cross slats 80, 82, and 84 are centrally positioned along the length of the frame 10 and have an L-shaped cross-section configuration. However, it should be noted that the L-shaped cross slats may be positioned elsewhere along the length of the frame 64 or be employed in a lesser or a greater number. The L-shaped cross slats 80, 82, and 84 act as reinforcing braces or beams to reduce deflection of the frame 64.

As illustrated in FIG. 5, the non-resilient bedding foundation 60 has a mattress support assembly 86. The mattress support assembly 86 comprises a plurality of wire support members 88 supported on and attached to the cross slats 68, 70, 72, 74, 76, 78, 80, 82, and 84. In this embodiment, a top layer 63 is applied over the assembly 86 and a cover or ticking 90 is provided to form the exterior surface for the entire foundation 60. The top layer 63 is similar in construction and performance to the bottom layer 68 of the mattress 30. Particularly, the top layer 63 is designed to provide a rigid support surface for the mattress 30 with a firmness above 30 ILD and specifically above 55 ILD.

The one-sided inner spring mattress 30 constructed according to the invention offers considerable advantages over prior art conventional two-sided mattresses in terms of reducing the amount of permanent deflection of the sleeping surface due to undesirable compaction of padding materials. Because the mattress 30 essentially has a 50 percent reduction in padding due to the rigid bottom layer 38, the coil assembly 12 does not settle into and compact a lower padding layer as would happen with a two-sided mattress of conventional construction having identical padding layers on both sides. The addition of a rigid foundation beneath the one-sided mattress 30 also provides additional support for the coil springs of the mattress 30 and thus helps further reduce sagging.

The one-sided mattress 30 of the invention also offers the advantage of eliminating maintenance of the mattress by periodically turning it over as is recommended for conventional two-sided mattresses. Accordingly, the one-sided mattress 30 is more convenient for the consumer to use. Further, the Marshall coil construction or open spring construction use conventional materials so that the one-sided mattress 30 may be readily manufactured by techniques that are well known in the industry. The foundation 60 likewise can be constructed using conventional manufacturing techniques.

While the present invention has been described in connection with certain embodiments thereof, it will be apparent to those skilled in the art that many changes and modifications can be made without departing from the true spirit and scope of the present invention. Accordingly, it is intended by the appended claims to cover all such changes and modifications as come within the scope of the invention.

What is claimed is:

1. An inner spring mattress assembly adapted to be used with only one of its sides as a sleeping surface for a user, comprising:

a full-length central core comprising a wire spring assembly made of open coils, said open coils connected at least proximate to the periphery of the central core by a wire;

a full-length quilted upper padding layer extending over a top surface of the core and defining the sleeping surface;

a lower layer made of substantially rigid high density foam that underlies the core and has a firmness of greater than 30 ILD, and a connector coupled to the wire and securing the central core against the lower layer:

wherein the lower layer supports the central core and is resistant to compaction by the central core of springs, thereby reducing permanent deflection of the sleeping surface by the user.

2. The mattress assembly of claim 1 wherein the lower layer has a firmness of approximately 55 ILD.

3. The mattress assembly of claim 1 wherein said wire comprises a border wire and is secured to said lower layer by attaching said border wire to said lower layer.

4. An inner spring assembly according to claim 1, wherein the connector includes a hog ring secured to the wire.

5. An innerspring assembly according to claim 1, wherein the lower layer further includes at least one layer of sheeting material.

6. An innerspring assembly according to claim 5, wherein the connector includes a hog ring secured to the wire and to the sheeting material.

7. An innerspring assembly according to claim 1, wherein the lower layer includes at least one layer of high density foam and at least one layer of sheeting material.

8. An innersnring assembly according to claim 1, wherein the connector connects the wire to a peripheral edge of the mattress.

9. An innerspring assembly according to claim 1, further comprising a layer of sheeting material disposed over an exterior side of the lower layer and attached to a border on a side of the mattress to define an exterior, non-sleeping surface.

10. An innerspring mattress assembly according to claim 9, wherein the wire comprises a lower border wire and the connector comprises a hog ring.

11. An innerspring mattress assembly according to claim 9, wherein the lower layer includes at least one layer of high density foam and at least one layer of sheeting material.

12. An innerspring mattress assembly according to claim 11, wherein the lower layer has a firmness of at least 40 ILD.

13. An inner spring mattress assembly adapted to be used with only one of its sides as a sleeping surface for a user, comprising:

a full-length central core comprising a wire spring assembly made of pocketed springs, said springs connected at least proximate to the periphery of the central core by a wire;

a full-length quilted upper padding layer extending over a top surface of the core and defining the sleeping surface;

a lower layer made of substantially rigid high density foam that underlies the core and has a firmness of greater than 30 ILD, a connector coupled to the wire and securing the central core against the lower layer; and wherein the lower layer supports the central core and is resistant to compaction by the central core of springs, thereby reducing permanent deflection of the sleeping surface by the user.

14. The mattress assembly of claim 13 wherein the lower layer has a firmness of approximately 55 ILD.

15. A bed construction comprising:

a full-length inner spring mattress assembly adapted to be used with only one of its sides as a sleeping surface for a user comprising:

a full-length central core comprising a wire spring assembly made of open coils, said open coils connected at least proximate to the periphery of the central core by a wire;

a full-length quilted upper padding layer extending over a top surface of the core and defining the sleeping surface;

a lower layer made of substantially rigid high density foam that underlies the core and has a firmness of greater than 30 ILD, a connector coupled to the wire and lower layer and securing the wire against the lower layer;

a rigid foundation facing said lower layer and supporting the mattress; and wherein the lower layer supports the central core and is resistant to compaction by the central core of springs, thereby reducing permanent deflection of the sleeping surface by the user.

16. A The bed construction of claim 15 wherein the lower layer has a firmness of approximately 55 ILD.

17. The bed construction of claim 15 wherein said wire comprises a border wire and is secured to said lower layer by attaching said border wire to said lower layer.

18. A bed construction comprising:

a full-length inner spring mattress assembly adapted to be used with only one of its sides as a sleeping surface for a user, said mattress assembly comprising:

a full-length central core comprising a wire spring assembly made of pocketed springs, said pocketed springs connected at least proximate to the periphery of the central core by a wire;

a full-length quilted upper padding layer extending over a top surface of the core and defining the sleeping surface;

a lower layer made of substantially rigid high density foam that underlies the core and has a firmness of greater than 30 ILD;

a connector connecting to the wire and securing the central core to the lower layer; and wherein the lower layer is resistant to compaction by the central core of springs and supports the central core, thereby reducing permanent deflection of the sleeping surface by the user, and a rigid foundation facing said lower layer and supporting the mattress.

19. The bed construction of claim 18 wherein the lower layer has a firmness of at least approximately 55 ILD.

20. An inner spring mattress assembly adapted to be used with only one of its sides as a sleeping surface for a user, comprising:

a full-length central core comprising a wire spring assembly made of a plurality of interconnected spring coils connected together proximate to the periphery of the central core by a wire;

a full-length quilted unper padding layer extending over a top surface of the central core and defining the sleeping surface;

a lower layer made of at least one layer of substantially rigid high density foam underlying the core and having a firmness of greater than 30 ILD;

a connector cooperating with the wire to secure the central core against the lower layer; and a layer of sheeting material disposed over an exterior side of the lower layer and attached to a border on a side of the mattress to define an exterior, non-sleeping surface;

wherein the lower layer supports the central core and is resistant to compaction by the spring coils of the central core, thereby reducing permanent deflection of the sleeping surface by the user.

* * * * *